US005449906A

United States Patent [19]

Osbourne

[11] Patent Number: 5,449,906

[45] Date of Patent: Sep. 12, 1995

[54] CORONA GENERATING ELECTRODE REPLACEMENT TOOL

[75] Inventor: William G. Osbourne, Webster, N.Y.

[73] Assignee: Xerox Corporation, Stamford, Conn.

[21] Appl. No.: 176,734

[22] Filed: Jan. 3, 1994

[51] Int. Cl.[6] ..... H01T 19/04

[52] U.S. Cl. ..... 250/324

[58] Field of Search ..... 250/324, 325, 326; 361/230

[56] References Cited

U.S. PATENT DOCUMENTS

| | | | |
|---|---|---|---|
| 3,691,373 | 9/1972 | Compton et al. | 250/324 |
| 4,020,315 | 4/1977 | Euler | 219/91 |
| 4,099,219 | 7/1978 | Laing | 361/230 |
| 4,118,751 | 10/1978 | Hubble III, et al. | 361/220 |
| 4,163,307 | 8/1979 | Papendick et al. | 29/25.19 |
| 4,258,258 | 3/1981 | Laing et al. | 250/324 |
| 4,442,356 | 4/1984 | Ludwick et al. | 250/324 |
| 5,074,484 | 12/1991 | Kray | 242/129.8 |

*Primary Examiner*—Bruce C. Anderson
*Attorney, Agent, or Firm*—Denis A. Robitaille

[57] ABSTRACT

A method and apparatus for replacing a corona generating electrode assembly in a housing, wherein a plurality of replacement electrodes are removably mounted in a configuration substantially equivalent to the operational configuration thereof on a rigid support frame. The procedure for replacing a malfunctioning or otherwise spent corona generating electrode is substantially facilitated through a relatively simple "snap-fit" process, wherein replacement is accomplished by pressing the housing against the corona generating electrode assembly on the rigid support frame so as to simultaneously mount the corona generating electrode in the housing while removing the corona generating electrode from the rigid support frame. The tool provides substantial time savings while yielding incidental advantages by reducing breakage of new electrodes as often occurs during replacement using prior techniques.

9 Claims, 3 Drawing Sheets

CORONA GENERATING ELECTRODE REPLACEMENT TOOL

The present invention relates generally to a reusable corona generating device for use in an electrostatographic printing machine and, more particularly, is directed to a tool for installing a pretensioned, glass-coated wire in a corona charging device.

Many machines and apparatus, such as electrostatographic copiers and printers, employ one or more thin conductive wires that must be installed between two or more points or members. The operation of installing or replacing such wires, which are often quite frail and brittle, can be difficult for a number of reasons, including the need to avoid damaging, overtensioning or breaking the wire as it is strung between the required points. Moreover, the wire may be very difficult to handle, in many cases leading to multiple unsuccessful attempts to engage an undamaged wire between the retaining points.

By way of example, in the electrostatographic reproducing arts, it is necessary to deposit a uniform electrostatic charge on an imaging surface, wherein the charge is subsequently dissipated in a selective manner by exposure to an information containing optical image for forming an electrostatic latent image on the imaging surface which is then developed and transferred to a support surface for forming a final copy of the original document. It is common practice to use a corona generating device, or so called corotron, for depositing the electrostatic charge on the imaging surface. A typical configuration for a corotron incorporates a thin wire corona generating electrode mounted between two insulating end blocks which support the electrode in a highly tensioned manner, as well as in a substantially singular plane. The corona generating electrode may be partially enclosed by a conductive shield so as to increase the corona current produced thereby.

In addition to charging the imaging surface in an electrostatographic system, corona generating devices are used to perform a variety of other functions in the electrostatographic process. For example, corona generating devices are utilized for: transferring an electrostatic toner image from a reusable photoconductive imaging member to a transfer member such as paper; tacking and detacking the transfer member to and from the imaging member; and conditioning of the surface of the imaging member prior to, during, and after deposition of toner thereon for improving the quality of the electrostatographic copy produced thereby. Each of these functions are carried out by a separate and independent corona generating device. The relatively large number of devices within a single machine necessitates the economical use of corona generating devices.

Various types of corona generating devices are known in the art. One particular corona generating device in commercial use, for example, includes a single corona generating electrode strung between insulating end blocks mounted on either end of a channel formed by a U-shaped shield or a pair of spaced side shield members. The corona generating electrode is typically a highly conductive, elongated wire, situated in close proximity to the surface to be charged. Other conventional corona generating devices are known, wherein the corona generating electrode may be in the form of a pin array. Another device, frequently used to provide more uniform charging and to prevent overcharging, includes two or more corona generating electrodes and a control grid comprising a screen having a plurality of parallel wires or a plate having multiple apertures positioned between the corona generating electrodes and the imaging member. In this device, a potential having the same polarity as that applied to the corona generating electrodes but having a much smaller voltage magnitude is applied to the control grid to suppress the electric field between the control grid and the corona generating electrodes, thereby markedly reducing the ion current flow therefrom.

Yet another type of corona generating device is described in U.S. Pat. No. 4,086,650 to Davis et al., wherein a corona discharge electrode is coated with a dielectric material such as glass for substantially preventing the flow of conduction current therethrough. In this device, the delivery of charge to the photoconductive member is accomplished by a displacement current or by capacitive coupling through the dielectric material. The flow of ions to the surface to be charged is regulated by means of a DC bias applied to the shield of the corona generating device. This device has the advantage of providing a uniform charge to the photoconductive member using a charge generating device. However, since the electrode is comprised of a thin outer coating of a typically very brittle material, it may be easily damaged. Thus, merely handling the electrode for mounting on the end supports of a typical corona generating device often results in an unacceptable fracture in the dielectric coating.

One problem associated with corona generating devices occurs in the presence of the generated corona, wherein a region of high chemical reactivity is also generated, such that new chemical compounds are synthesized in the machine air. This chemical reactivity correspondingly causes a build up of chemical growth on the corona generating electrode as well as other surfaces adjacent thereto. After a prolonged period of operation, these chemical growths not only degrade the performance of the corona generating device but also the entire electrostatographic machine. The electrostatographic environment also creates toner accumulation on the surface of the corona generating electrode as well as surfaces adjacent thereto. These spots of accumulated toner, being a dielectric in nature, tend to cause localized charge buildup on the interior surfaces of the shield, which causes current nonuniformity and reduction in corona current. Localized toner accumulations on the insulating end blocks which support the wire electrode also cause sparking.

Although thin wire corona generating devices are noted for their ability to produce a reasonably uniform electrostatic charge, the environment in which the corona generating electrode operates often causes irregularities and degradation in charging uniformity which may be traced to irregularities on the electrode surface. While cleaning the corona generating electrode may serve to improve the general operating characteristics of the corona generating device, it usually will become necessary to replace the corona generating electrode due to further degradation in performance, or breakage of the electrode, which often occurs while cleaning.

Correcting the problems associated with a degraded or a broken corotron wire can present a series of difficulties. Most notably, installing and tensioning a corona generating electrode can be a delicate operation. The use of pliers, hooks, screwdrivers and other tools often results in damage to the electrode. Likewise, merely handling these fragile electrodes, in particular those which are coated with a dielectric material, as discussed hereinabove, often results in damage to the same, which can result in uneven charging that would effect copy or print quality after the wire is placed into the machine. In most cases, extreme care must be taken to avoid damage to the wire during installation thereof.

In the past a variety of arrangements have been used to install, support and/or mount a corona generating electrode into position within a corona generating device. Since replacement of a corona generating electrode usually takes place in the field by a skilled technician, ease of replacement in a minimum amount of time is essential. The following disclosures may be relevant:

U.S. Pat. No. 5,074,484
Patentee: Kray
Issued: Dec. 24, 1991
U.S. Pat. No. 4,258,258
Patentee: Laing et al.
Issued: Mar. 24, 1981
U.S. Pat. No. 4,118,751
Patentee: Hubble, III et al.
Issued: Oct. 3, 1978
U,.S. Pat. No. 4,099,219
Patentee: Laing
Issued: Jul. 4, 1978

U.S. Pat. No. 5,074,484 teaches a corotron restringing tool that includes a locking drum downstream from a spool of corotron wire to be strung between points. A torsion spring connected to the locking drum allows the wire to be drawn from the spool under a minimum of tension and subsequently manipulated without placing tension on the remaining wire on the spool.

U.S. Pat. No. 4,258,258 discloses a corona generating device having a corona generating electrode supported between a pair of end block assemblies. Each end block assembly defines a space for the passage of the electrode, and nonconductive inserts for surrounding the electrodes that are seated in the spaces of the end block assemblies. The nonconductive inserts are made from a high dielectric strength material that is also resistant to a corrosive atmosphere. The inserts are easily and inexpensively replaced so as to protect the end block assemblies from the effects of high voltage applied to the corona electrode.

U.S. Pat. No. 4,118,751 teaches a corona discharge device having a coronode of the type including a wire electrode coated with a fractureable dielectric sleeve for example, glass. Electrical contact is made to the wire via a conductive member forcibly attached or crimped to the sleeve to fracture it sufficiently to permit direct contact between the wire and the member.

U.S. Pat. No. 4,099,219 discloses a corona generating electrode, or so called coronode, in the form of a wire supported between insulating end block assemblies. A thin wire coated coronode includes a dielectric coating which may be formed into enlarged beads adjacent the ends thereof. The coronode beads rest jointly on the floors of the cavities provided in each end block assembly and may also be supported on a tin pedestal or elongated support which spans the end block assemblies. One end block assembly includes a member movable into abutment with the bead to apply an adjustable tensioning force to the coronode.

Notwithstanding the results obtained through the use of the aforementioned patents, problems still exist in the process of installing the corona generating electrode in the frame of a corona generating device. Moreover, the process of replacing a corona generating device is an expensive and time consuming process, requiring the skills of a trained technician. Quite often, when a worn wire must be removed from the corona generating device for replacement by a new wire, many attempts must be made, and many wires are broken or damaged in the process. More frequently, the entire corona generating device is treated as a disposable assembly, whereby the entire device is removed and replaced by a new device so as to bypass the entire delicate process of replacing the electrode. This practice is costly and wasteful.

It would be desirable to facilitate the replacement of a corona generating electrode in a corona generating device as utilized in electrophotographic machines. Therefore, a need has been shown for a tool or arrangement capable of allowing the rewiring of a corona generating device while preventing damage thereto.

In accordance with one aspect of the present invention, an apparatus for replacing a wire mounted in a predetermined configuration is provided, comprising a rigid support frame, and means for removably mounting the wire on the support frame in a configuration substantially similar to the predetermined configuration such that the wire can be removed therefrom in the predetermined configuration.

In accordance with another aspect of the present invention, a tool is provided for replacing a corona generating electrode assembly in a housing. The tool includes a rigid support frame, and means for removably mounting the corona generating electrode assembly in a pretensioned configuration on the support frame such that the electrode can be mounted in the housing while being maintained in the pretensioned configuration.

In accordance with yet another aspect of the present invention, a method for replacing a corona generating electrode in a housing is disclosed, comprising the steps of: providing a rigid support frame having a corona generating electrode assembly mounted thereon in a configuration for being installed in the housing; positioning the housing over the corona generating electrode assembly on the rigid support frame; and pressing the housing against the corona generating electrode assembly on the rigid support frame so as to simultaneously mount the corona generating electrode in the housing while removing the corona generating electrode from the rigid support frame.

These and other aspects of the present invention will become apparent from the following description in conjunction with the accompanying drawings, in which.

As indicated hereinabove, the present invention provides a novel tool for replacing an electrode in a corona generating device, typically utilized in an electrostatographic printing machine. However, it will be apparent that the novel tool of the present invention may be useful outside of the realm of electrostatographic printing machines, and, more generally, may be useful in various systems in which it is necessary to mount a fragile or pretensioned wire on a frame or housing. While the present invention will be described with reference to a preferred embodiment thereof, it will be understood that the invention is not to be limited to this preferred embodiment. On the contrary, it is intended that the present disclosure cover all alternatives, modifications, and equivalents as may be included within the spirit and scope of the invention as defined by the appended claims. Other aspects and features of the present invention will become apparent as the description proceeds.

Figure 3:
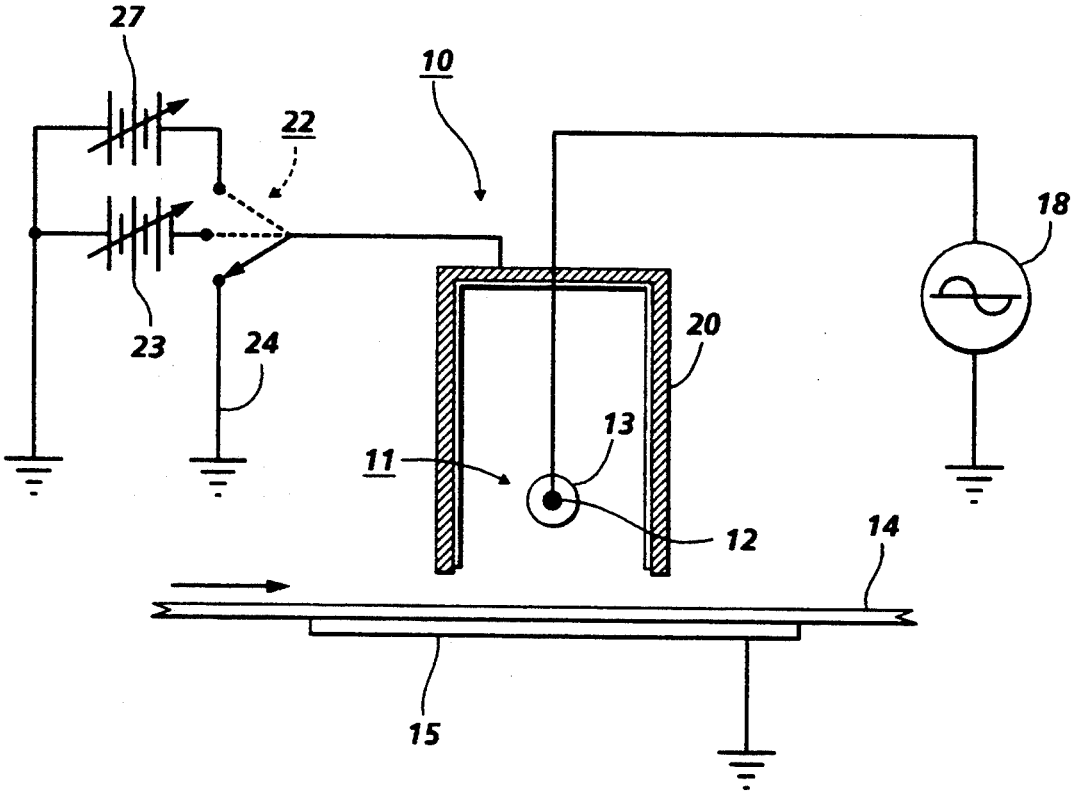
FIG. 3 is a cross sectional schematic view of an illustrative prior art corona generating device.

The details of construction and operation of a corona generating device are well known in the art and do not form a part of the present invention. However, a brief description of a typical corona generating device will be provided for the benefit of the unitiated. Thus, referring initially to FIG. 3, prior to describing the present invention in detail, an exemplary corona generating device 10 having a corona generating electrode 11, is shown. For illustrative purposes, the corona generating electrode 11 is shown in the form of a conductive wire 12 having a relatively thick coating 13 of dielectric material such as glass or some other suitable substance. A corona generating device incorporating this type of electrode is generally known in the art as a "dicorotron". It will be understood that the electrode 11 might take the alternative form of a pin array, a thin wire, or a plurality of pin arrays or thin wires, comprised of any material or configured in any manner as may be known in the art. As such, the figures and description of the present invention, as provided herein, are provided for the purpose of illustrating an exemplary embodiment of the present invention and are not intended to limit the same.

A charge collecting surface 14, which may be a photoconductive surface in a conventional electrostatographic system, is situated in close proximity to the corona generating device, as shown. The charge collecting surface 14 is carried on a conductive substrate 15 held at a reference potential that is usually machine ground. An AC voltage source 18 is connected between the surface 14 and the corona wire 12. The frequency of the AC source 18 may be varied widely in the range from 60 hertz (the frequency of electric power supply in the United States) to several megahertz. The device normally operates satisfactorily at a frequency of 4 KHz.

A conductive shield member 20 is located adjacent the corona generating electrode 11, substantially enclosing the electrode on all sides except the side opposite the chargeable surface 14. The shield is shown as being substantially rectangularly U-shaped, but any of the conventional shapes used for corona shields in the electrostatographic art may be employed. In fact, the function of the shield 20 may be performed by any conductive member, for example, a base wire, in the vicinity of the discharge electrode 11, the precise location not being critical to obtain satisfactory operation of the device.

The corona generating electrode 11 may be supported in a conventional fashion at the ends of the corona generating device 10 by insulating end blocks (not shown) mounted within the ends of the shield structure 20. The conductive wire 12 may be made of any conventional conductive filament material such as stainless steel, gold, aluminum, copper, tungsten, platinum or the like. The diameter of the wire is not critical and may vary typically between 0.5–15 mils and is preferably about 9 mils.

Any suitable dielectric material which will not breakdown under the applied corona AC voltage, and which will withstand chemical attack under the the conditions present in a corona device may be employed as the coating 13. The thickness of the dielectric coating 13 used in the corona device is such that substantially no conduction current or DC charging current is permitted therethrough. Typically, the thickness is such that the combined wire and dielectric thickness is in the range of from 7–30 mils, with a typical dielectric thickness being approximately 2–10 mils. Glass materials having a dielectric breakdown strength above 2 KV/mil at 4 KHz and in the range of 2 to 5 mil thickness have been found to perform satisfactorily as the dielectric coating material 13.

During a typical charging operation, an AC voltage is applied to the corona generating electrode 11. The magnitude of the AC voltage is generally in the range of 4 KV to 7 KV, having an applied frequency between 1 Khz to 10 Khz. The shield member 20 is connected to a switch 22 which, depending upon its position, permits the corona generating device to be operated in either a charge neutralizing mode or a charge deposition mode. With the switch 22 positioned as shown, the shield of the corona device is coupled to ground via a lead 24. In this position, no DC field is generated between the surface 14 and the shield 20 such that, the corona generating device operates to neutralize any charge present on the surface 14. Alternatively, with switch 22 in either of the positions shown by dotted lines, the shield member 20 is connected to a DC source 23 or 27, so as to apply a biasing voltage to the shield member 20 for establishing a DC field between the surface 14 and the shield 20. With the conductive substrate of the imaging member at ground potential, a typical negative DC bias voltage ranging between about 800 volts to about 4 KV is applied to the shield. In this position, the corona generating device 10 operates to deposit a net charge onto the surface 14, the polarity and magnitude of which is dependent upon the polarity and magnitude of the DC bias applied to the shield 20. For further details of the manner of operation of the above described dicorotron device, attention is directed to U.S. Pat. No. 4,086,650 to Davis et al., which is hereby incorporated in its entirety into the instant disclosure.

Figure 1:
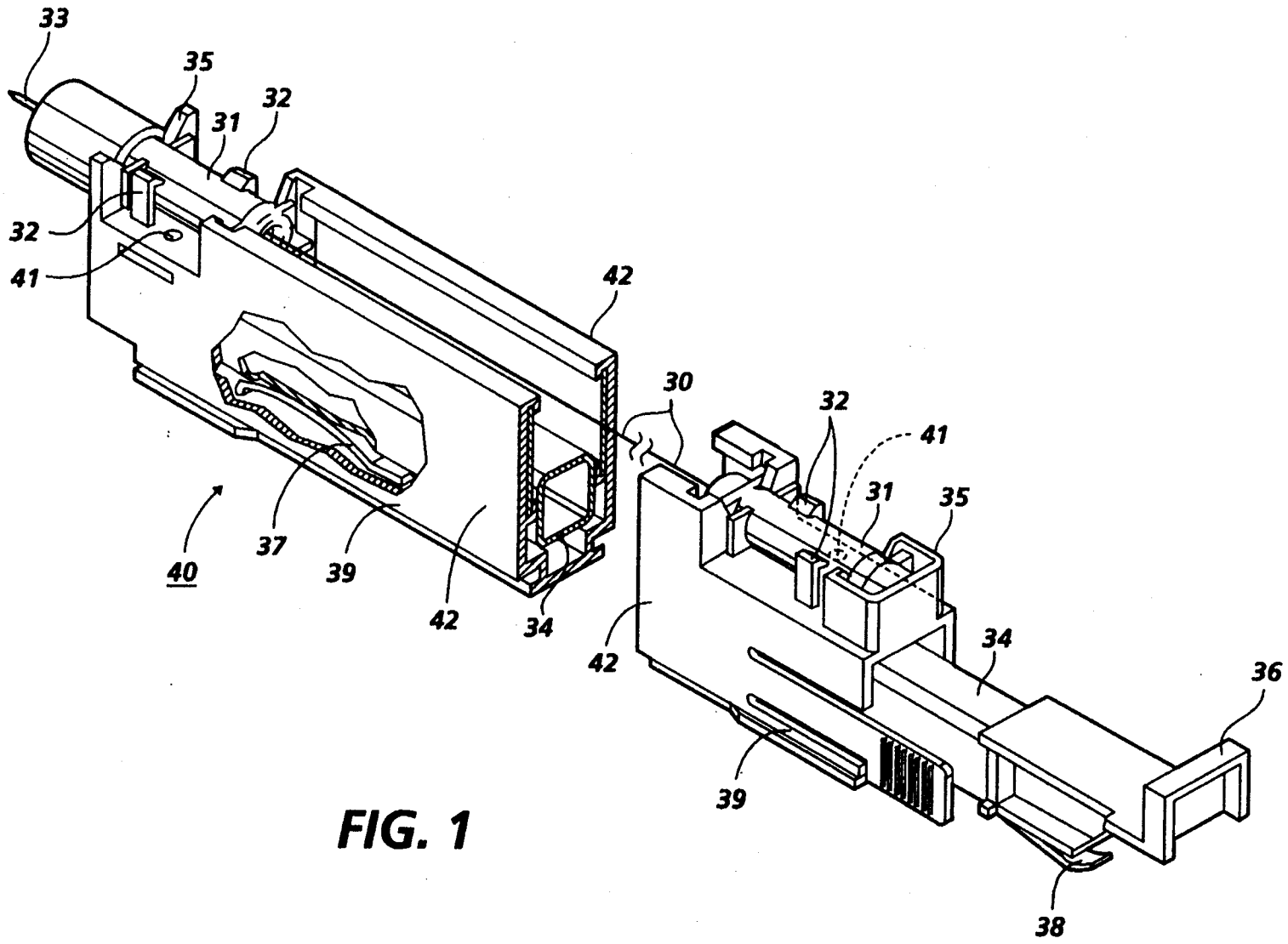
FIG. 1 is a perspective view of a typical corona generating device.

Moving now to FIG. 1, a preferred embodiment of a corona generating device which may be utilized in conjunction with the present invention, is shown, wherein an elongated corona generating electrode 30 is supported within an elongated housing, generally identified by reference numeral 40, which may be made from any suitable material. The housing 40 may represent the shield element of a typical corona generating device, as discussed with reference to FIG. 3, or, in the alternative, may represent a frame upon which a conductive shield may be disposed. The housing 40 is generally characterized by an open faced body including a base 39 and a pair of side panels 42 extending along the length of the housing. The electrode 30 is mounted in a predetermined configuration in the housing 40 for exposing the electrode 30 to the surface to be charged.

A corona generating electrode assembly includes an electrode 30 and cylindrical mounting anchors 31 situated at opposite ends thereof for facilitating the mounting of the electrode in the housing 40. These anchors are generally extruded from a high dielectric strength insulator such as ceramic, polyvinylchloride or nylon, among other materials. Various mounting anchors of this nature have been disclosed in the art, as shown, for example, in U.S. Pat. No. 4,258,258. The mounting anchors 31 are also useful for facilitating handling of the electrode as well as for protecting the end blocks 35 from the effects of high voltage applied to the corona generating electrode 30. At least one of the mounting anchors 31 includes a high voltage contact pin 33 for providing the necessary coupling to an AC power supply to apply a biasing voltage to the corona generating electrode 30 when properly mounted in the machine.

Figure 2:
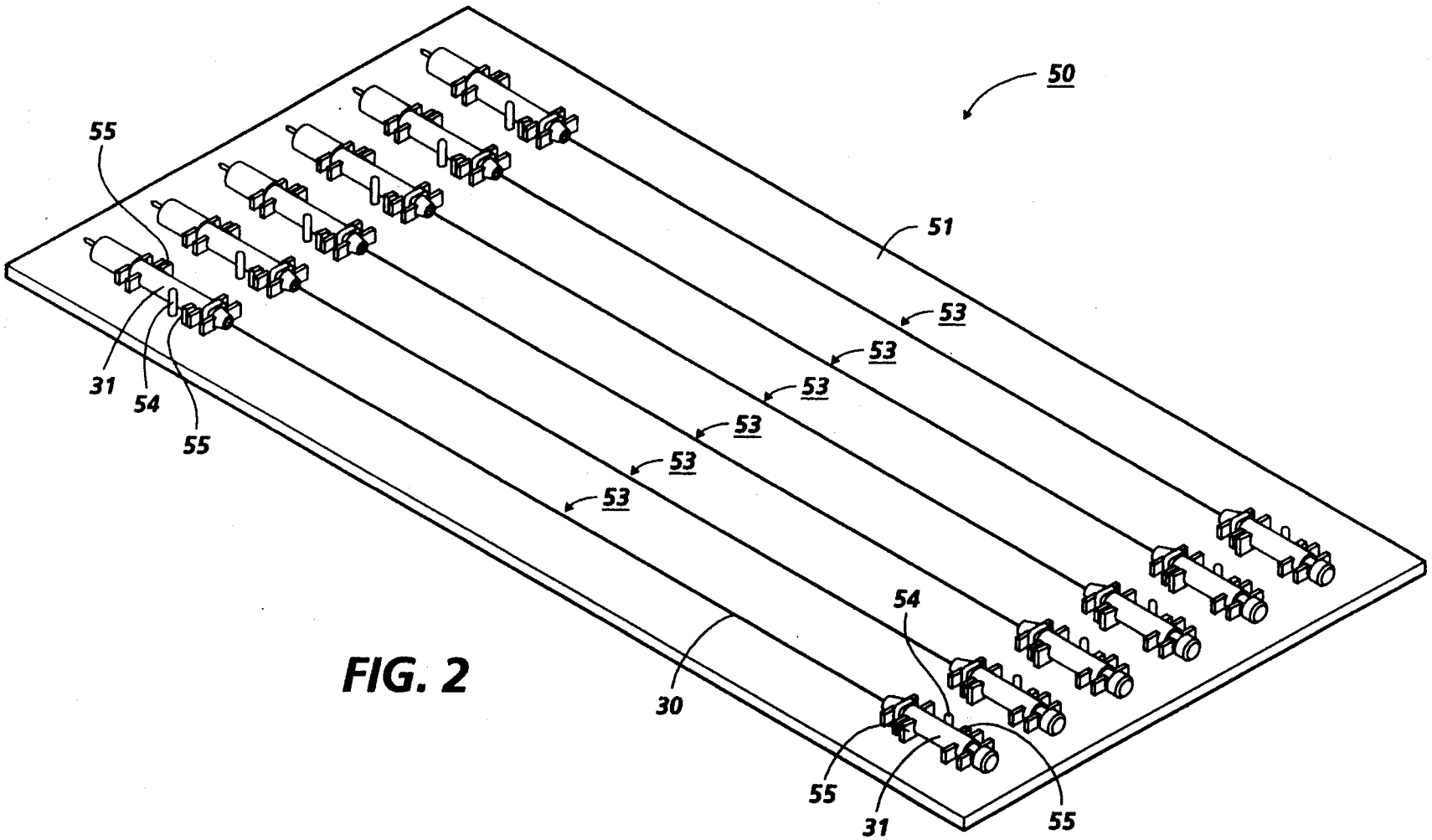
FIG. 2 is perspective view of a preferred embodiment of a corona generating electrode replacement tool and loading assembly in accordance with the present invention.

The corona generating electrode assembly is supported in housing 40 on end blocks 35, located at opposite ends of the elongated housing 40. Each end block 35 includes a pair of spaced resilient finger elements 32 for receiving the cylindrical mounting anchors 31 of the corona generating electrode assembly. The end blocks 35 are adapted to hold the anchors 31 at a fixed distance apart for maintaining a predetermined tension on the electrode. It will be understood that a slack condition in the electrode is undesirable as such sagging of the electrode will result in nonuniform spacing of the wire from the surface to be charged, causing nonuniform charging thereof. Each end block 35 also includes at least one alignment aperture 41 for mating with a corresponding alignment pin, as will be described hereinbelow with reference to FIG. 2.

As described, housing 40 forms a support structure for receiving a replaceable corona generating electrode assembly in a predetermined configuration adapted to provide a typical corona generating device. Moving now to FIG. 2, a preferred embodiment of a corona generating electrode replacement tool 50 in accordance with the present invention is shown, wherein a plurality of corona generating electrode assemblies 53, each comprising an electrode 30 and cylindrical mounting anchors 31, are mounted on a rigid support frame or platform 51. The rigid support frame 51 may be made from a single, one piece molding of any suitable material having sufficient structural integrity.

Each corona generating electrode assembly 53 is supported on the rigid support frame 51 via anchors 31 in a configuration and manner substantially similar to the configuration and manner in which the corona generating electrode assembly is mounted on housing 40. Each anchor is supported on the frame 51 by means of a pair resilient fingers 55, respectively situated on opposite sides of each anchor 52. Respective sets of resilient fingers 55 are located in alignment with one another at opposite ends of the frame 51 and spaced accordingly so as to maintain a predetermined tension on the corona generating electrode 30 with a corona generating electrode assembly 53 mounted therein. The resilient fingers 55 are further designed to removably receive the anchor 31. An alignment pin 54 is also located in an area adjacent each set of fingers 55 for cooperatively engaging with alignment apertures 40 located on each end block 35 of housing 39, shown in FIG. 2.

A description of the operation of the replacement tool of the present invention will now be provided. Generally, after prolonged use or failure of the corona generating device, a service technician will initiate the procedure for replacing the corona generating electrode by removing the housing 39 from its mounting position within the machine. Once the housing is removed from the machine, the corona generating electrode assembly can be removed from the housing by simply prying the anchors 31 away from the resilient fingers 32 on each end block 35. The empty housing is then positioned over an electrode assembly 53 on frame 51 such that alignment pins 54 mate with alignment apertures 41 to align the housing 39 relative to a given corona generating electrode assembly 53. Thereafter, replacement of the electrode is completed by merely pressing the housing 39 against the electrode assembly 53 on rigid support frame 51 so as to release the anchors 31 thereof from the resilient fingers 55 and to engage resilient fingers 32 with the anchors 31. The alignment pins 54 also serve to prevent the housing 39 from moving when snapping the new wire assembly 52 into the housing 39. The housing 40 is then lifted away from the rigid support frame 51, yielding a reconditioned corona generating device having a new corona generating electrode.

It is thus seen that the procedure for replacing a malfunctioning or otherwise spent corona generating electrode is substantially facilitated through a relatively simple "snap-fit" process involving a mounting system wherein a plurality of corona generating electrode assemblies are removably mounted in a configuration substantially equivalent to the operational configuration thereof. Replacement is accomplished by pressing a housing against the corona generating electrode assembly on the rigid support frame so as to simultaneously mount the corona generating electrode in the housing while removing the corona generating electrode from the rigid support frame. The resulting time savings associated with this process and system are self evident. In addition, the tool provides incidental advantages by reducing breakage of new electrodes as often occurs during replacement using prior techniques.

In recapitulation, it is evident that the corona generating electrode replacement tool described herein includes a frame for having a plurality of corona generating electrodes removably mounted thereon. Each electrode is mounted in a configuration substantially equivalent to the configuration in which a corona generating electrode is mounted within a housing. Using this tool, a corona generating electrode assembly is replaced in a housing by merely positioning the housing over the electrode on the support frame so as to snap the electrode into position in the housing.

It is, therefore, evident that there has been provided, in accordance with the present invention, a corona generating electrode replacement tool that fully satisfies the aims and advantages of the invention as hereinabove set forth. While the invention has been described in conjunction with a preferred embodiment thereof, it is evident that many alternatives, modifications, and variations may be apparent to those skilled in the art. Accordingly, the patent is intended to embrace all such alternatives, modifications, and variations as are within the broad scope and spirit of the appended claims.

I claim:

1. An apparatus for mounting a wire in a predetermined configuration within a housing, comprising:

a rigid support frame including means for removably supporting the wire in a configuration substantially similar to the predetermined configuration; and means for removing the wire from said support frame with the housing positioned in alignment with the wire on said support frame such that the wire can be removed therefrom in said predetermined configuration while simultaneously being secured within the housing.

2. The apparatus of claim 1, wherein said supporting means includes a pair of resilient fingers for releasably gripping the wire.

3. The apparatus of claim 1, further comprising:

alignment means for aligning said housing with the wire on said rigid support frame.

4. The apparatus of claim 3, wherein:

said housing defines an alignment aperture; and said support frame including an alignment pin being cooperative with the alignment aperture in the housing for aligning said housing with the wire on said rigid support frame.

5. A tool for mounting a corona generating electrode assembly in a housing, comprising:

a rigid support frame including means for removably supporting the wire in a pretensioned configuration; and means for removing the corona generating electrode assembly from said support frame with the housing positioned in alignment with the wire on said support frame such that the electrode can be removed therefrom and simultaneously mounted in the housing while being maintained in the pretensioned configuration.

6. The tool of claim 5, wherein:

the corona generating electrode assembly includes a pair of mounting anchors and a conductive electrode situated therebetween; and said supportinq means includes a pair of resilient fingers for releasably gripping each of said pair of mounting anchors.

7. The tool of claim 5, further including alignment means for aligning the housing with the corona generating electrode assembly on said rigid support frame.

8. The tool of claim 7, wherein:

the housing defines an alignment aperture; and said rigid support frame includes an alignment pin cooperative with the alignment aperture in the housing for aligning the housing with the wire on said rigid support frame.

9. A method for installing a corona generating electrode in a housing, comprising the steps of:

providing a rigid support frame having a corona generating electrode assembly removably supported thereon in a configuration for being installed in the housing;

positioning the housing over the corona generating electrode assembly on the rigid support frame; and pressing the housing against the corona generating electrode assembly on the rigid support frame so as to mount the corona generating electrode in the housing while simultaneously removing the corona generating electrode from the rigid support frame.

* * * * *